US006349444B1

(12) United States Patent
Sander

(10) Patent No.: US 6,349,444 B1
(45) Date of Patent: Feb. 26, 2002

(54) SHAFT MOUNTED MANUAL CLEANING IMPLEMENT

(75) Inventor: Don Sander, Fairfield, IA (US)

(73) Assignee: Harper Brush Works, Inc., Fairfield, IA (US)

( * ) Notice: Subject to any disclaimer, the term of this patent is extended or adjusted under 35 U.S.C. 154(b) by 0 days.

(21) Appl. No.: 09/354,043

(22) Filed: Jul. 15, 1999

(51) Int. Cl.[7] ..... B25G 3/12; A46B 17/02
(52) U.S. Cl. ..... 15/146; 15/175; 15/176.3
(58) Field of Search ..... 15/175, 171, 146, 15/176.1, 176.6, 176.4, 176.3, 228; 16/440

(56) References Cited

U.S. PATENT DOCUMENTS

| | | | | |
|---|---|---|---|---|
| 1,143,752 A | | 6/1915 | Crisman | |
| 1,311,657 A | * | 7/1919 | Levins | 15/146 |
| 1,760,268 A | | 5/1930 | Cave | |
| 1,838,448 A | * | 12/1931 | Pomfret | 15/146 |
| 1,983,923 A | * | 12/1934 | Stevens et al. | 15/146 |
| 2,163,979 A | | 6/1939 | Judson | |
| 2,423,658 A | * | 7/1947 | Priem | 15/145 |
| 2,514,571 A | * | 7/1950 | Fry | 15/145 |
| 2,648,860 A | | 8/1953 | Le Febvre | |
| 2,834,035 A | | 5/1958 | Vosbikian et al. | |
| 3,052,907 A | * | 9/1962 | Kubick | 15/146 |
| 3,084,369 A | | 4/1963 | Hawkins | |
| 3,512,203 A | | 5/1970 | McClellan, Jr. | |
| 4,215,448 A | | 8/1980 | Burns et al. | |
| 4,763,378 A | | 8/1988 | Drumm | |
| 5,319,822 A | | 6/1994 | Shaw | |
| 5,333,344 A | | 8/1994 | Frieb | |
| 5,471,699 A | * | 12/1995 | Shaw | 15/146 |
| 5,502,862 A | | 4/1996 | Vosbikian | |
| 5,568,668 A | | 10/1996 | Margolin | |
| D375,409 S | | 11/1996 | Uranga et al. | |

FOREIGN PATENT DOCUMENTS

| | | | | |
|---|---|---|---|---|
| CH | 251854 | * | 9/1948 | 15/146 |
| CH | 290221 | * | 7/1953 | 15/146 |
| FR | 1349296 | * | 12/1963 | 15/146 |

* cited by examiner

*Primary Examiner*—Gary K. Graham
(74) *Attorney, Agent, or Firm*—Welsh & Katz, Ltd.

(57) ABSTRACT

A connector for multi-directionally mounting and securing a manual cleaning implement, such as a broom head, to a shaft, includes a main body portion having a collar for receiving the shaft. The main body portion has an upper mounting flange for mounting to an upper surface of the cleaning implement. The upper mounting flange has an opening therein for receiving a fastener, such as a bolt. The connector includes at least one lower mounting flange having a depending portion for extending around a side surface of the cleaning implement and a hook portion for mounting to a lower surface of the cleaning implement. The fastener is inserted into the opening in the upper mounting flange for multi-directionally securing the connector to the cleaning implement.

15 Claims, 2 Drawing Sheets

SHAFT MOUNTED MANUAL CLEANING IMPLEMENT

FIELD OF THE INVENTION

This invention pertains to a cleaning implement, such as a broom or squeegee, that is shaft mounted. This invention pertains to a manual cleaning implement that is shaft mounted and a connector for connecting the head of the cleaning implement with the shaft.

BACKGROUND OF THE INVENTION

Shaft mounted cleaning implements, such as brooms, squeegees, mops, brushes and the like have been used for centuries to help maintain general cleanliness and to, for example, remove dirt and clean up spills. A variety of different types of implements are known and are currently used. Many such implements are designed and manufactured for relatively lightweight, residential use. Other implements are designed for heavier-duty commercial use. These commercial implements can be used for hours each day and as such can be subjected to considerable wear and tear.

Cleaning implements, such as brooms, mops, squeegees and brushes typically include an elongated head portion that is positioned transverse to the area being cleaned. For example, a broom includes an elongated head that is pushed or pulled in a direction for sweeping, that is transverse to the elongated dimension of the broom head. The head further includes bristles that are affixed thereto for sweeping the dirt and/or debris.

A number of different types of mechanical connections are used for connecting the elongated shaft to the implement head. In one simple mechanical arrangement, the shaft end includes a thread and the implement head includes a bore having a thread complementary to the shaft thread. The shaft is simply threaded into the head and tightened to achieve a snug fit of the shaft into the implement head. This is probably the most readily recognized type of connection between the implement head and shaft. However, as will be recognized by consumers and professionals alike, this connection can become loose in which case the implement can become useless.

In another type of arrangement, the implement head includes an upstanding collar into which the shaft is fitted. The shaft can then be fastened to the collar using, for example, bolts, screws, and the like. Although this provides a relatively strong connection between the shaft and the implement head, an excessive lateral force on the shaft can crack the collar or loosen the shaft from the collar.

For use in commercial applications, it is known to use a steel brace and connecting arrangement to mount the shaft to the implement head. In such an arrangement, a steel connector is affixed to the implement head at about a central point along the longitudinal length of the head at a top surface of the head. A pair of arms extend from the implement head, spaced from the central connector, and are affixed to the shaft upwardly spaced from the central connector. This type of connector provides a rigid connection of the shaft to the implement head, and withstands lateral forces that may be exerted on the shaft. This type of support does, however, have its drawbacks. For example, the steel connections and support arms can be quite heavy and can thus add considerable weight to the cleaning implement. When the cleaning implement is used in a commercial application, this additional weight can result in added stresses on the user's arms, back and shoulders.

In addition, this type of metal or steel connecting arrangement can require a considerable number of mechanical connections between the implement head and the shaft. In a typical arrangement, three to eight sets of fasteners are needed in order to properly secure the shaft to the implement. These fasteners can become loosened during use thus, requiring maintenance. In the event that these fasteners become excessively loose, damage can occur to the mechanical connectors as well as to the implement head and/or shaft. Moreover, because these parts can be used in wet environments, steel parts must either be coated, such as by powder coating, or formed from relatively expensive corrosion resistant materials, such as stainless steel.

Accordingly, there exists a need for cleaning implement and connector arrangement that provides lateral support between the implement shaft and head. Desirably, such a connector arrangement is readily installed on the implement head with a minimum number of fasteners. Most desirably, such a connector arrangement is lightweight and high-strength to reduce the strain on a user and to increase the connection strength between the shaft and the implement head.

SUMMARY OF THE INVENTION

A connector is disclosed for multi-directionally mounting and securing a manual cleaning implement, such as a broom head to a shaft. The cleaning implement that is used with the connector has an upper surface, a lower surface and a side surface generally transverse to and connecting the upper and lower surfaces.

The connector includes a main body portion having a collar for receiving the shaft. The main body portion has an upper mounting flange for mounting to the upper surface of the cleaning implement. The upper mounting flange has an opening therein for receiving a fastener for securing to the cleaning implement.

The connector includes at least one, and preferably two lower mounting flanges, each including a depending portion for extending around the side surface of the cleaning implement and a hook portion for engaging the lower surface of the cleaning implement. Most preferably, the lower mounting flanges are symmetrically disposed on the connector relative to the collar. The fastener secures the connector to the cleaning implement.

In a current embodiment, the main body portion is formed having a fan-like divergent shape that defines an upper face and a lower face. The divergent body extends from the collar to the upper mounting flange and is generally symmetrical about the collar. To provide strength and rigidity to the connector, the main body portion can include ribs, preferably formed on the lower face, that extend from about the lower mounting flange to the collar. Ribs can also be formed on the lower face extending from about the lower mounting flange to an adjacent edge of the main body portion.

The main body portion can be formed with a concave area formed centrally therein that extends from about the collar to the upper mounting flange. A longitudinal rib can be formed in the concave portion extending at least in part between the collar and the upper mounting flange, and transverse ribs can be formed intersecting the longitudinal rib.

In a preferred embodiment, the lower mounting flange extends from the main body portion at about a juncture of the main body portion and the upper mounting flange.

For use with a pushing implement, such as a broom head, the main body portion is formed at an angle relative to the upper mounting flange of about 130 degrees to about 145 degrees, and preferably about 138 degrees.

An alternate embodiment of the connector includes a projection extending from each of the lower mounting flange depending portions. The projections are configured to insert into bores formed in the side surfaces of the cleaning implement head.

Other features and advantages of the present invention will be apparent from the following detailed description, the accompanying drawings, and the appended claims.

DETAILED DESCRIPTION OF THE PREFERRED EMBODIMENTS

Figure 1:
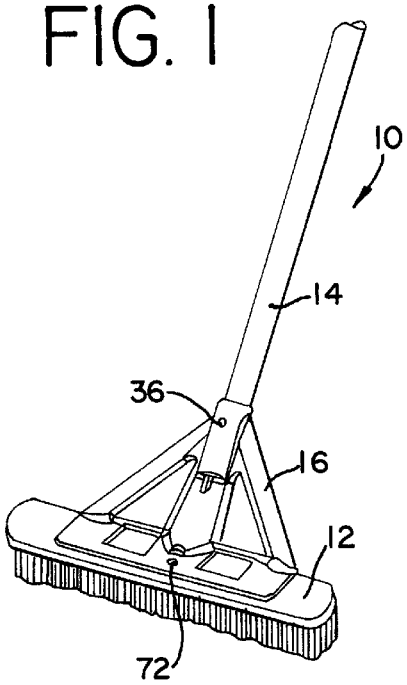
FIG. 1 is a perspective view of an exemplary broom having a broom head mounted and secured to a shaft with a connector in accordance with the principles of the present invention.
Figure 2:
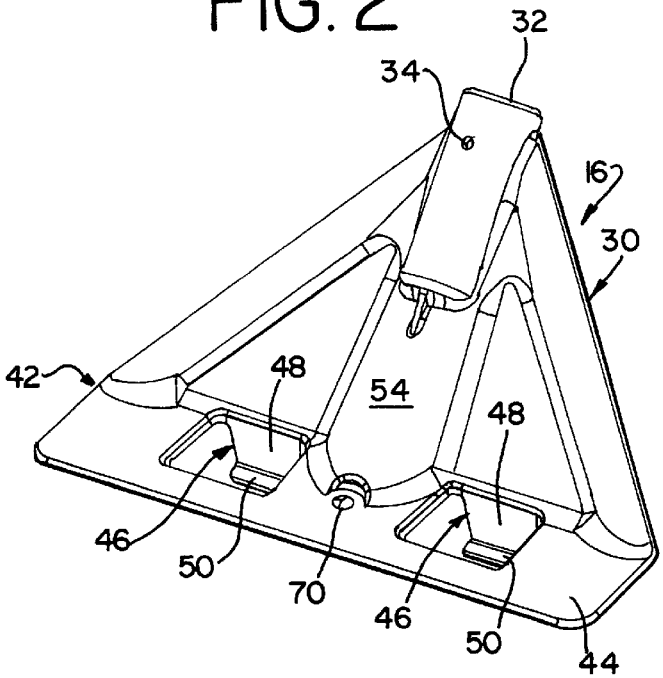
FIG. 2 is a front perspective view of the connector illustrated with the broom head and the shaft removed for clarity of illustration.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures, and in particular to FIG. 1, there is shown a broom 10 having a broom head 12, a shaft 14, and a connector 16 in accordance with the principles of the present invention. While the present invention will be described with respect to a broom 10, it will be readily recognized by those skilled in the art that the present invention can be used in connection with brooms, brushes, mops, squeegees and the like. In a general sense, the present connector 16 can be used in conjunction with any manual, handled implement that uses an elongated shaft for operating, e.g., pushing, or pulling a cleaning implement.

The implement, for example, the broom head 12 has a main body 18 defining an upper surface 20 that generally defines a plane that is parallel to the surface being cleaned. The main body 18 includes a lower surface 22 that is in opposing relation to the upper surface 20 and at least one lateral or side surface 24 extending between and connecting the upper and lower surfaces 20, 22. In a typical configuration, the broom head 12 is formed from a block of, for example, wood or a polymeric material. The broom head 12 includes bristles 26 that are mounted to and depend from the lower surface 22.

Figure 5:
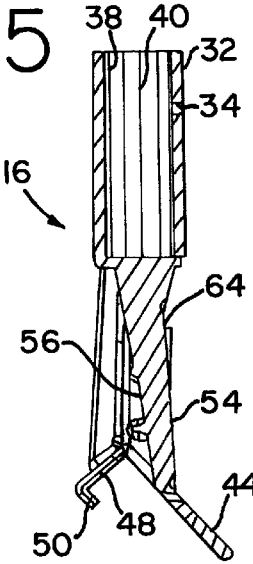
FIG. 5 is a cross-sectional view taken along line 5—5 of FIG. 3.
Figure 10:
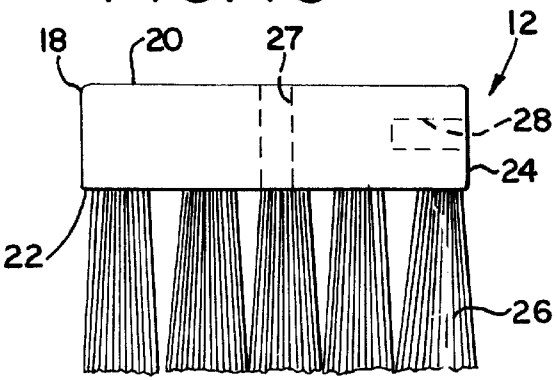
FIG. 10 is a side view of a broom head that can be used with both embodiments of the connector.

Referring to FIGS. 1–4 the connector 16 provides a rigid, structural, lightweight, multi-directional connection between the shaft 14 and the broom head 12. The connector 16 includes a main body portion 30 that defines a sleeve or collar 32 for receiving the shaft 14. The collar 32 can include an opening 34 through one or both side so that a fastener 36 can be inserted through the opening 34, into the shaft 14 to secure the shaft 14 to the connector 16. In a preferred embodiment, as seen in FIG. 5, the interior surface 38 of the collar 32 includes ribs 40 for snuggly securing the shaft 14 within the collar 32. The collar 32 can be tapered to further facilitate securing the shaft 14 in the collar 32.

Referring again to FIGS. 2–4, the connector body 30 has a divergent, fan-like shape extending outwardly from the collar 32 to the head mount 42. The head mount 42 includes an upper mounting flange 44 that is configured to abut the broom head upper surface 20 and at least one, and preferably a pair of lower mounting flanges 46 that engage the lower surface 22 of the broom head 12. Each lower flange 46 includes a depending portion 48 and a hook portion 50 extending transversely therefrom. The hook portion 50 is configured to engage the broom head lower surface 22 and the depending portion 48 is configured to lie adjacent the side surface or wall 24 of the broom head 12. In a preferred embodiment, the lower mounting flange 46 extends from the connector 16 at about a juncture of the main body portion 30 and the upper mounting flange 44, as indicated at 52.

Figure 7:
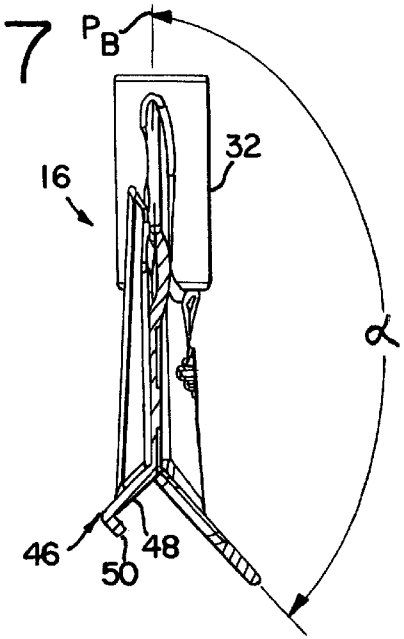
FIG. 7 is a cross-sectional view taken along line 7—7 of FIG. 3.
Figure 6:
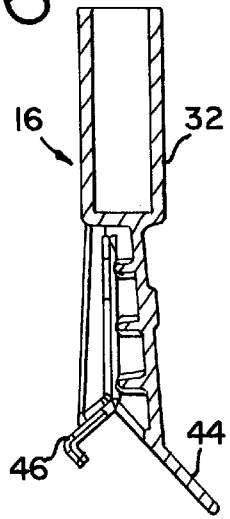
FIG. 6 is a cross-sectional view taken along line 6—6 of FIG. 3.

The main body 30 is a substantially planar member that, as set forth above, has a general divergent, fan-like shape having an upper face 54 and a lower face 56. As seen in FIG. 7, a plane $P_B$ defined by the main body 30 extends in generally the same direction as the shaft 14 that is mounted to the connector 16. In this manner, any force exerted on the shaft 14 will be transmitted to the main body 30 in the generally same direction as that force. In addition, any transverse or lateral force that is exerted on the shaft 14 will be transferred to the connector 16 in the plane $P_B$ of the main body 30. Because of the triangular, i.e., divergent, fan-like shape, these forces are generally transmitted to the main body 30 along the body plane $P_B$, and can be readily accommodated by the connector 16.

The upper mounting flange 44 is formed at an angle $\alpha$ relative to the main body plane $P_B$. The angle oc between the upper mounting flange 44 and the plane $P_B$ is about 130 degrees to about 145 degrees, and preferably about 138 degrees.

Figure 3:
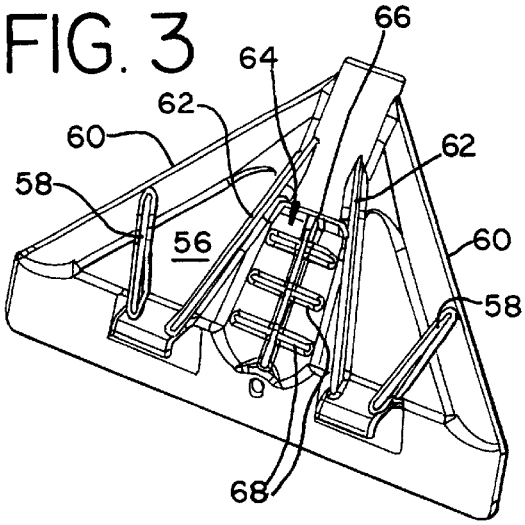
FIG. 3 is a rear perspective view of the connector illustrated with the broom head and the shaft removed for clarity of illustration.
Figure 4:
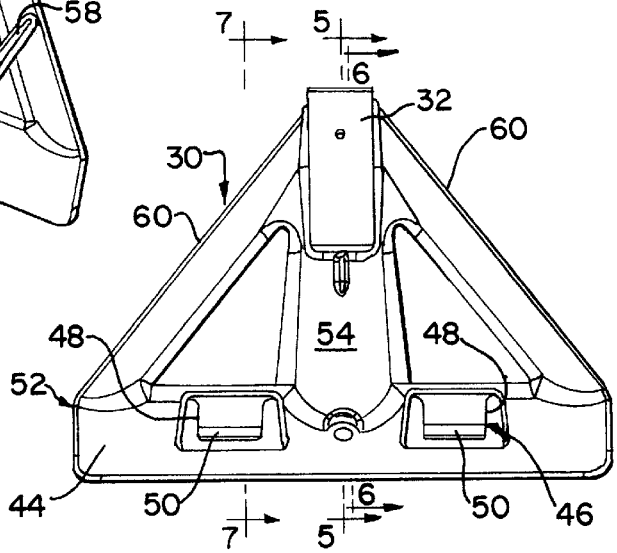
FIG. 4 is a top view of the connector of FIGS. 2 and 3.

The main body portion 30 includes a plurality of strengthening structures, such as ribs that extend along the main body 30. In a present embodiment, as seen in FIG. 3, a first pair of ribs 58 is formed in the lower surface 56, extending from the divergent edges 60 to the lower mounting flanges 46 and a second pair of ribs 62 is formed in the lower surface 56 extending from shaft collar 32 to the lower flanges 46.

The main body 30 can be formed with additional strengthening structures such as ribs that extend between the end of the shaft collar 32 and the upper mounting flange 44. In the current embodiment, that portion of the main body 32 has an upwardly curved or concave surface as indicated at 64 and includes a main longitudinal rib 66 that extends from the end of the shaft collar 34 downwardly toward the upper mounting flange 44 and a plurality of lateral ribs 68 that intersect the main longitudinal rib 66. All of these ribs 66, 68 can be formed within the concave portion 64 of the body 30. This combination of ribs provides not only strength, but also enhances the rigidity of the overall connector structure.

The connector 16 includes a novel fastening arrangement to secure it to the broom head 12. The fastening arrangement provides multi-directional support and mounting of the head 12 to the connector 16. The upper mounting flange 44 is configured with an opening 70 therein for receiving a fastener 72, such as a exemplary bolt, that is inserted through the flange opening 70, through an opening 27 in the broom head 12, and fastened thereto. The flange opening 70 is formed in the upper flange 44 at about a longitudinally central location. In this manner, the broom head 12 is secured to the connector 16 in at least two directions, that is, downwardly toward the surface being cleaned by the upper flange 44 and fastener 72 and, because the lower mounting flange 46 wraps around or cups the broom head 12, in a direction parallel to the direction of the surface that is being cleaned. This novel fastener arrangement provides a secure, structurally sound connection between the broom head 12 and the shaft 14.

Another advantage of the present connector 16 design is that it permits readily reversing or rotating the broom head 12. As will be recognized by those using brooms 10 in commercial applications, the bristles 26 can tend to wear or become permanently bent or curled when used. To this end, the broom head 12 can be rotated to prevent bristle 26 curling and to prolong the life of the broom head 12.

Figure 9:
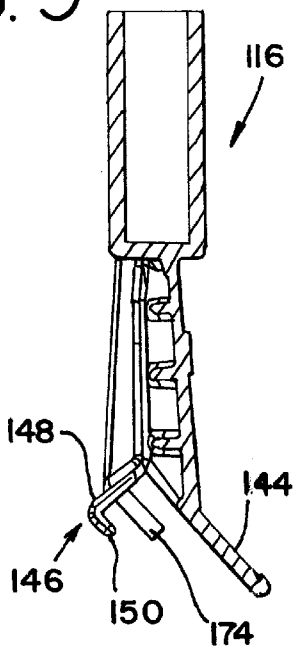
FIG. 9 is a cross-sectional view similar to FIG. 6 of the alternate connector embodiment of FIG. 8.
Figure 8:
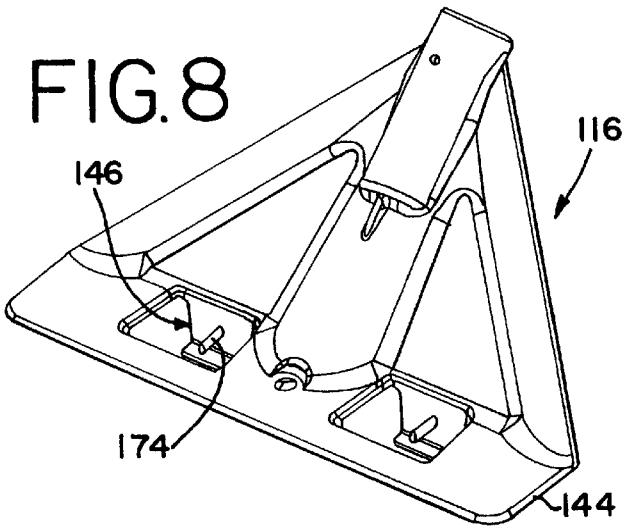
FIG. 8 is a perspective view similar to FIG. 2 of an alternate embodiment of the connector of the present invention.

As seen in FIGS. 8 and 9, an alternate embodiment of the connector 116 includes, in addition to the upper and lower mounting flanges 144, 146, a finger or projection 174 that extends from each of the depending portions 148 of the lower flanges 146 that inserts into a bore 28 that is formed in the side wall 24 of the broom head 12. The engagement of the fingers 174 with the broom head bores 28 further prevents lateral shifting of the broom head 12, and, in conjunction with the upper and lower mounting flanges 144, 146 provides an enhanced, secured engagement of the connector 116 with the broom head 12.

In a present embodiment, the connector 16, 116 is formed from a polymeric material that is high strength, yet lightweight. Such materials include polypropylene, nylon acrylic, polycarbonate, polybutylene and the like. Other materials include a variety of high density polymers such as high density polyethylene. It is contemplated that injection molding will be used to form the connector 16, 116.

Although the connector 16, 116 has been described with respect to a broom 10, it will be appreciated by those skilled in the art that the connector 16, 116 can be used with any manual push or pull type implement, or any implement that is used in a sweeping motion. Moreover, the present connector 16, 116 can also be applied to garden tools, such as rakes, hoes, shovels and the like, all of which implements are within the scope of the present invention.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A connector for multi-directionally mounting and securing a manual cleaning implement to a shaft, the cleaning implement having an upper surface, a lower surface and a side surface generally transverse to and connecting the upper and lower surfaces, the connector comprising a main body portion having a collar for receiving the shaft, the main body portion having a substantially triangular divergent shape defining an upper face and a lower face, a divergent body extending from the collar to the upper mounting flange, the divergent body being generally symmetrical about the collar, the main body portion having an upper mounting flange for mounting to the upper surface of the cleaning implement, the collar being spaced from the upper mounting flange, the upper mounting flange having an opening therein, and at least one lower mounting flange including a depending portion for extending around the side surface of the cleaning implement and a hook portion for engaging the lower surface of the cleaning implement, the connector including a pair of lower mounting flanges disposed generally symmetrically relative to the collar, opening in the upper mounting flange being configured to receive a fastener for securing the connector to the cleaning implement, wherein the main body portion includes at least a pair of ribs formed on the lower face, each rib extending from about the lower mounting flange to the collar.

2. The connector in accordance with claim 1 wherein the lower mounting flanges extend from the main body portion at about a juncture of the main body portion and the upper mounting flange.

3. The connector in accordance with claim 1 wherein the main body portion is formed at an angle relative to the upper mounting flange of about 130 degrees to about 140 degrees.

4. A connector for multi-directionally mounting and securing a manual cleaning implement to a shaft, the cleaning implement having an upper surface, a lower surface and a side surface generally transverse to and connecting the upper and lower surfaces, the connector comprising a main body portion having a collar for receiving the shaft, the main body portion having a substantially triangular divergent shape defining an upper face and a lower face, a divergent body extending from the collar to the upper mounting flange, the divergent body being generally symmetrical about the collar, the main body portion having an upper mounting flange for mounting to the upper surface of the cleaning implement, the collar being spaced from the upper mounting flange, the upper mounting flange having an opening therein, and at least one lower mounting flange including a depending portion for extending around the side surface of the cleaning implement and a hook portion for engaging the lower surface of the cleaning implement, the connector including a pair of lower mounting flanges disposed generally symmetrically relative to the collar, opening in the upper mounting flange being configured to receive a fastener for securing the connector to the cleaning implement, the connector including a pair of ribs formed on the lower face, each rib extending from about the lower mounting flange to an adjacent edge of the main body portion.

5. The connector in accordance with claim 4 wherein the lower mounting flanges extend from the main body portion at about a juncture of the main body portion and the upper mounting flange.

6. The connector in accordance with claim 4 wherein the main body portion is formed at an angle relative to the upper mounting flange of about 130 degrees to about 140 degrees.

7. A connector for multi-directionally mounting and securing a manual cleaning implement to a shaft, the cleaning implement having an upper surface, a lower surface and a side surface generally transverse to and connecting the upper and lower surfaces, the connector comprising a main body portion having a collar for receiving the shaft, wherein the main body portion includes a concave area formed therein extending from about the collar to an upper mounting flange for mounting to the upper surface of the cleaning implement, wherein a longitudinal rib is formed in the concave portion extending at least in part between the collar and the upper mounting flange, the upper mounting flange having an opening therein, and at least one lower mounting flange including a depending portion for extending around the side surface of the cleaning implement and a hook portion for engaging the lower surface of the cleaning implement, wherein the opening in the upper mounting flange is configured to receive a fastener for securing the connector to the cleaning implement.

8. A connector for multi-directionally mounting and securing a manual cleaning implement to a shaft, the cleaning implement having an upper surface, a lower surface and a side surface generally transverse to and connecting the upper and lower surfaces, the connector comprising a main body portion having a collar for receiving the shaft, the main body portion having an upper mounting flange for mounting to the upper surface of the cleaning implement, the collar being spaced from the upper mounting flange, the upper mounting flange having an opening therein, a pair of lower mounting flanges each including a depending portion for extending around the side surface of the cleaning implement, the lower mounting flanges disposed generally symmetrically relative to the collar, including a projection extending from each of the lower mounting flange depending portions, the projections configured to insert into associated bores formed in the side surfaces of the cleaning implement, and a hook portion for engaging the lower surface of the cleaning implement, wherein the opening in the upper mounting flange is configured to receive a fastener for securing the connector to the cleaning implement.

9. A manual cleaning implement comprising:

a shaft;

a head portion having an upper surface, a lower surface and a side surface generally transverse to and connecting the upper and lower surfaces, the head portion including a bore formed centrally therein;

a connector for multi-directionally mounting and securing the head portion to the shaft, the connector having a main body portion defining an upper face and a lower face, wherein the main body portion includes at least a pair of ribs formed on the lower face, the connector including a collar for receiving the shaft, the main body portion having an upper mounting flange for mounting to the upper surface of the head portion, the upper mounting flange having an opening therein in alignment with the head portion bore, the connector including a pair of lower mounting flanges disposed generally symmetrically relative to the collar, each lower mounting flange including a depending portion for extending around the side surface of the head portion, each rib from the main body portion extending from about the lower mounting flange to the collar, and a hook portion for engaging the lower surface of the head portion; and a fastener inserted through the upper surface opening and the head portion bore, and secured thereto.

10. The manual cleaning implement in accordance with claim 9 wherein the main body portion is formed having a substantially triangular divergent shape, a divergent body extending from the collar to the upper mounting flange and being generally symmetrical about the collar.

11. The manual cleaning implement in accordance with claim 9 including a pair of ribs extending from the lower mounting flange to an adjacent edge of the main body portion.

12. The manual cleaning implement in accordance with claim 9 wherein the lower mounting flanges extend from the main body portion at about a juncture of the main body portion and the upper mounting flange.

13. The manual cleaning implement in accordance with claim 9 wherein the main body portion is formed at an angle relative to the upper mounting flange of about 130 degrees to about 145 degrees.

14. The manual cleaning implement in accordance with claim 9 wherein the head portion is a broom head.

15. A manual cleaning implement comprising:

a shaft;

a head portion having an upper surface, a lower surface and a side surface generally transverse to an connecting the upper and lower surfaces, the head portion including a bore formed centrally therein;

a connector for multi-directionally mounting and securing the head portion to the shaft, the connector having a main body portion defining an upper face and a lower face, the connector including a collar for receiving the shaft, the main body portion having an upper mounting flange for mounting to the upper surface of the head portion, the upper mounting flange having an opening therein in alignment with the head portion bore, the connector including a pair of lower mounting flanges, each lower mounting flange including a depending portion for extending around the side surface of the head portion, a projection extending from each of the lower mounting flange depending portions, the projections configured to insert into bores formed in the head portion side surface, and a hook portion for engaging the lower surface of the head portion; and a fastener inserted through the upper surface opening and the head portion bore, and secured thereto.

* * * * *

UNITED STATES PATENT AND TRADEMARK OFFICE

CERTIFICATE OF CORRECTION

PATENT NO. : 6,349,444 B1
DATED : February 26, 2002
INVENTOR(S) : Don Sander

It is certified that error appears in the above-identified patent and that said Letters Patent is hereby corrected as shown below:

Column 7,
Line 27, delete “surfaces” and replace with -- surface --.

Column 8,
Lines 4 and 48, delete “the” and replace with -- An --.

Signed and Sealed this

Twenty-fifth Day of October, 2005

JON W. DUDAS
*Director of the United States Patent and Trademark Office*